US011043346B2

(12) United States Patent
Ishikawa et al.

(10) Patent No.: US 11,043,346 B2
(45) Date of Patent: Jun. 22, 2021

(54) ELECTROMAGNETIC RELAY

(71) Applicant: DENSO ELECTRONICS CORPORATION, Anjo (JP)

(72) Inventors: Tomoko Ishikawa, Anjo (JP); Makoto Kamiya, Anjo (JP)

(73) Assignee: DENSO ELECTRONICS CORPORATION, Anjo (JP)

( * ) Notice: Subject to any disclaimer, the term of this patent is extended or adjusted under 35 U.S.C. 154(b) by 188 days.

(21) Appl. No.: 16/444,260

(22) Filed: Jun. 18, 2019

(65) Prior Publication Data

US 2019/0304726 A1 Oct. 3, 2019

Related U.S. Application Data

(63) Continuation of application No. PCT/JP2017/045888, filed on Dec. 21, 2017.

(30) Foreign Application Priority Data

Dec. 26, 2016 (JP) ..... 2016-251040

(51) Int. Cl.
*H01H 50/02* (2006.01)
*H01H 9/44* (2006.01)
(Continued)

(52) U.S. Cl.
CPC ..... *H01H 50/02* (2013.01); *H01H 1/54* (2013.01); *H01H 9/44* (2013.01); *H01H 9/443* (2013.01);
(Continued)

(58) Field of Classification Search
CPC ..... H01H 50/02; H01H 50/00; H01H 9/44; H01H 1/54; H01H 9/443; H01H 50/163; H01H 50/18; H01H 50/38; H01H 50/54
See application file for complete search history.

(56) References Cited

U.S. PATENT DOCUMENTS

2011/0241809 A1* 10/2011 Sugisawa ..... H01H 1/54 335/188
2013/0012037 A1* 1/2013 Enomoto ..... H01H 50/546 439/39
(Continued)

FOREIGN PATENT DOCUMENTS

JP 2008226547 A 9/2008

*Primary Examiner* — Mohamad A Musleh
(74) *Attorney, Agent, or Firm* — Harness, Dickey & Pierce, P.L.C.

(57) ABSTRACT

An electromagnetic relay includes a base frame including a main body supporting a fixed element, and a bottom plate having a plate thickness direction in an extending direction orthogonal to a central-axis line direction. An intermediate cover includes a covering plate facing a contact mechanism unit. An outer cover includes a top plate facing the bottom plate across the contact mechanism unit, and a first side plate extending from one end of the top plate and facing the covering plate. A first gap between the covering plate and the bottom plate in the extending direction and a second gap between the covering plate and the top plate in the extending direction are arranged to be substantially symmetric across the covering plate in the extending direction, the first gap and the second gap being on the first side plate.

6 Claims, 5 Drawing Sheets

(51) Int. Cl.

| | |
|---|---|
| ***H01H 1/54*** | (2006.01) |
| ***H01H 50/16*** | (2006.01) |
| ***H01H 50/18*** | (2006.01) |
| ***H01H 50/38*** | (2006.01) |
| ***H01H 50/54*** | (2006.01) |
| ***H01H 50/00*** | (2006.01) |

(52) U.S. Cl.
CPC ..... *H01H 50/00* (2013.01); *H01H 50/163* (2013.01); *H01H 50/18* (2013.01); *H01H 50/38* (2013.01); *H01H 50/54* (2013.01)

(56) References Cited

U.S. PATENT DOCUMENTS

| | | | | |
|---|---|---|---|---|
| 2014/0184366 | A1* | 7/2014 | Ito | H01H 50/546<br>335/189 |
| 2017/0069452 | A1* | 3/2017 | Hiroki | H01H 9/443 |

* cited by examiner

ELECTROMAGNETIC RELAY

CROSS REFERENCE TO RELATED APPLICATIONS

The present application is a continuation application of International Patent Application No. PCT/JP2017/045888 filed on Dec. 21, 2017, which designated the United States and claims the benefit of priority from Japanese Patent Application No. 2016-251040 filed on Dec. 26, 2016. The entire disclosures of all of the above applications are incorporated herein by reference.

TECHNICAL FIELD

The present disclosure relates to an electromagnetic relay.

BACKGROUND

An electromagnetic relay includes a coil that generates a magnetic force when energized, a contact unit that is opened and closed by the magnetic force, and arc-extinguishing magnets placed on a lateral side of the contact unit.

SUMMARY

According to an aspect of the present disclosure, an electromagnetic relay includes a contact mechanism unit, a base frame, a permanent magnet, an intermediate cover and an outer cover. The contact mechanism unit includes: a fixed element having a fixed contact; and a movable element having a movable contact facing the fixed contact in a central-axis line direction of a coil. The movable element reciprocates in the central-axis line direction in accordance with an energization state of the coil. The base frame includes: a main body that fixes and supports the fixed element; and a bottom plate that is a rectangular plate portion having a plate thickness direction in an extending direction that is orthogonal to the central-axis line direction. The bottom plate fixes and supports the main body, and the main body extends from the bottom plate in the extending direction. The base frame is formed integrally from an insulating material. The permanent magnet has a magnetic pole direction parallel to a width direction that is orthogonal to the central-axis line direction and the extending direction. The permanent magnet is placed in proximity, in the width direction, to the fixed element and the movable element. The intermediate cover includes: a magnet retainer that retains the permanent magnet; and a covering plate that is a rectangular plate portion extending in the width direction from an end of the magnet retainer in the central-axis line direction. The covering plate faces the contact mechanism unit, and the intermediate cover is formed integrally from an insulating material and supported and fixed by the base frame. The outer cover includes: a top plate extending in the central-axis line direction and the width direction and facing the bottom plate across the contact mechanism unit; a first side plate extending in a direction parallel to the extending direction from one end of the top plate in the central-axis line direction and facing the covering plate; a second side plate extending in a direction parallel to the extending direction from another end of the top plate in the central-axis line direction and facing the first side plate across the contact mechanism unit and the coil; and a pair of third side plates connected to the top plate, the first side plate and the second side plate. The outer cover is formed integrally from an insulating material, and the outer cover has an opening of a bathtub shape formed by the top plate, the first side plate, the second side plate and the pair of third side plates. The bottom plate is attached to the opening, and the outer cover covers the contact mechanism unit and the intermediate cover. A first gap formed between the covering plate and the bottom plate in the extending direction and a second gap formed between the covering plate and the top plate in the extending direction are arranged to be substantially symmetric across the covering plate in the extending direction. The first gap and the second gap are provided on the first side plate.

DETAILED DESCRIPTION

Figure 1:
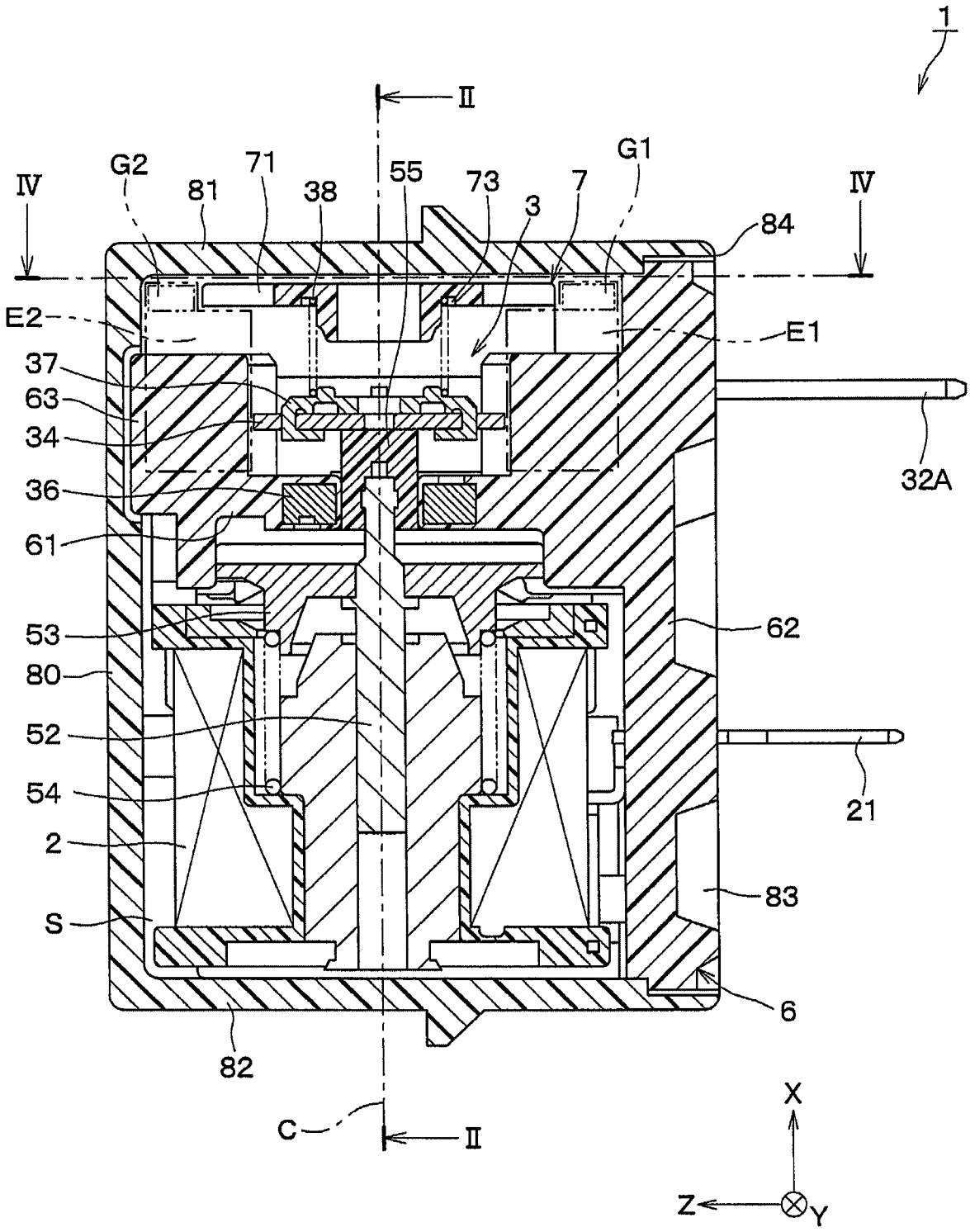
FIG. 1 is a sectional view illustrating a schematic configuration of an electromagnetic relay according to an embodiment.

An electromagnetic relay includes a coil that generates a magnetic force when energized, a contact unit that is opened and closed by the magnetic force, and arc-extinguishing magnets placed on a lateral side of the contact unit. The arc-extinguishing magnets are provided for using the Lorentz force to stretch and extinguish an arc that occurs at the contact unit during the transition from an energization state to a shutoff state. Extinguishing spaces for stretching an arc using the Lorentz force based on the magnetic flux of the arc-extinguishing magnets are placed on different outer sides of the arc-extinguishing magnets in a direction orthogonal to an opening/closing direction of the contact unit and a magnetic pole direction of the arc-extinguishing magnet.

In this type of electromagnetic relay, the size of the extinguishing space affects the shutoff performance significantly. Maximizing the extinguishing space can thus ensure high shutoff performance.

The direction of current flow in this type of electromagnetic relay can vary. In a specific example, a powering current and a regenerative current which flows in the direction opposite to the powering current may flow through an electromagnetic relay. To maintain favorable shutoff performance regardless of the direction of current flow in such cases, the size difference between an extinguishing space for shutting off the powering current and that for shutting off the regenerative current needs to be minimized.

An embodiment of the present disclosure is described with reference to the drawings below. Various changes applicable to the embodiment are presented as modifications together after the description of the embodiment.

(Configuration)

With reference to FIGS. 1 to 5, a configuration of an electromagnetic relay 1 according to the present embodiment is described. The electromagnetic relay 1 according to the present embodiment can be suitably used in a drive power supply system installed in an electrically driven vehicle including a hybrid vehicle. That is, the electromagnetic relay 1 is configured so as to be suitably installed in a power supply system that switches current flow between a powering current and a regenerative current, which flows in a direction opposite to that of the powering current.

The electromagnetic relay 1 includes a coil 2, a contact mechanism unit 3, a permanent magnet 4, a drive unit 5, a base frame 6, an intermediate cover 7, and an outer cover 8. The coil 2, the contact mechanism unit 3, the permanent magnet 4, the drive unit 5, and the intermediate cover 7 are accommodated in an accommodation space S surrounded by the base frame 6 and the outer cover 8.

A direction parallel to an X axis in each of the figures, that is, any direction parallel to a central axis line C of the coil 2, is referred to as a central-axis line direction. An X-axis negative direction in the figures is referred to as an attraction direction, and an X-axis positive direction is referred to as a return direction. When a direction parallel to the central axis line C is not specified as the attraction direction or the return direction, the term "central-axis line direction" is used hereinafter. The central-axis line direction can be also referred to as a contact opening/closing direction.

A Y-axis direction, which is a direction orthogonal to the central-axis line direction, in the figures is referred to as a width direction. A Z-axis direction, which is a direction orthogonal to the central-axis line direction and an extending direction, is referred to as an extending direction.

The coil 2 is placed on a one end side of the accommodation space S in the central-axis line direction (i.e., at an end of the accommodation space S toward the attraction direction). The coil 2, which generates a magnetic force when energized, is electrically connected to a coil terminal plate 21 secured to the base frame 6. The coil terminal plate 21 extends from the base frame 6 toward the outside of the electromagnetic relay 1 in a direction parallel to the extending direction (i.e., toward a Z-axis negative direction).

The contact mechanism unit 3 is placed in a location toward the return direction with respect to the coil 2. The contact mechanism unit 3 is configured to switch between an energization state and a shutoff state of the powering current or the regenerative current when driven by the drive unit 5 in accordance with an energization state of the coil 2. The contact mechanism unit 3 includes a first fixed element 31A, a second fixed element 31B, a first input/output terminal 32A, a second input/output terminal 32B, a first fixed contact 33A, a second fixed contact 33B, a movable element 34, a first movable contact 35A, a second movable contact 35B, a fixed yoke 36, a movable yoke 37, and a contact pressure spring 38.

The first fixed element 31A is a metal plate having a tongue-like shape. The first fixed element 31A has a longitudinal direction thereof in the extending direction and a plate thickness direction thereof in the central axis line direction. The first fixed element 31A is placed toward a Y-axis positive direction with respect to the central axis line C. The second fixed element 31B is a metal plate having a tongue-like shape. The second fixed element 31B has a longitudinal direction thereof in the extending direction and a plate thickness direction thereof in the central axis line direction. The second fixed element 31B is placed toward a Y-axis negative direction with respect to the central axis line C. That is, the first fixed element 31A and the second fixed element 31B are arranged in the width direction. The first fixed element 31A and the second fixed element 31B are supported firmly by the base frame 6, which is made from an insulating material (for example, synthetic resin), such that the first fixed element 31A and the second fixed element 31B are electrically isolated from each other in the shutoff state.

The first fixed element 31A is formed integrally and seamlessly with the first input/output terminal 32A, which is a metal plate having a tongue-like shape. The first input/output terminal 32A extends from the base frame 6 toward the outside of the electromagnetic relay 1 in a direction parallel to the extending direction (i.e., toward the Z-axis negative direction). The second fixed element 31B is formed integrally and seamlessly with the second input/output terminal 32B, which is a metal plate having a tongue-like shape. The second input/output terminal 32B extends from the base frame 6 toward the outside of the electromagnetic relay 1 in a direction parallel to the extending direction (i.e., toward the Z-axis negative direction). One of the first input/output terminal 32A and the second input/output terminal 32B is electrically connectable to a power source side of the power supply system described above, while the other one thereof is electrically connectable to a load in the power supply system (for example, a motor generator that functions as an electric motor and a generator).

Figure 3:
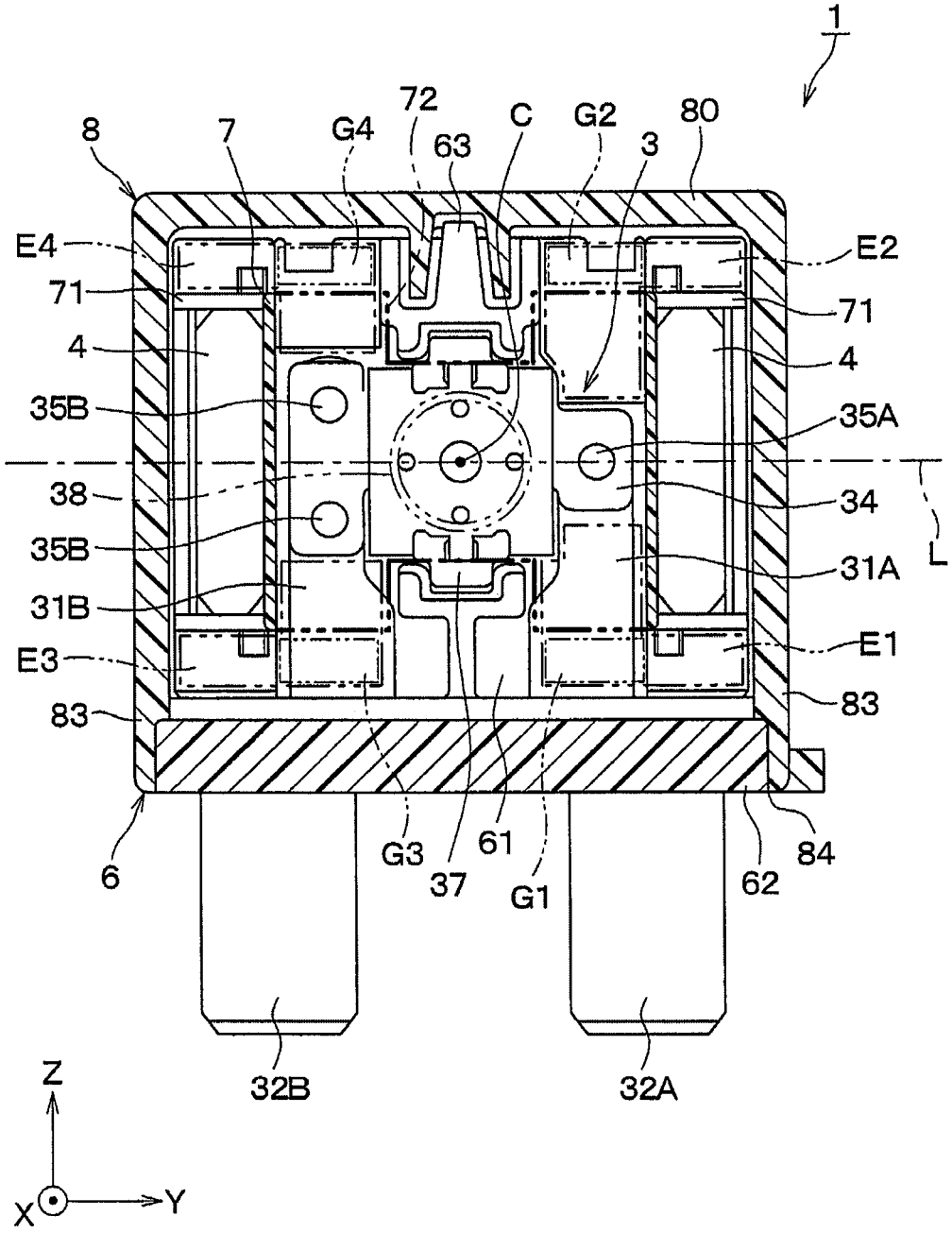
FIG. 3 is a sectional view taken along line III-III in FIG. 2.
Figure 4:
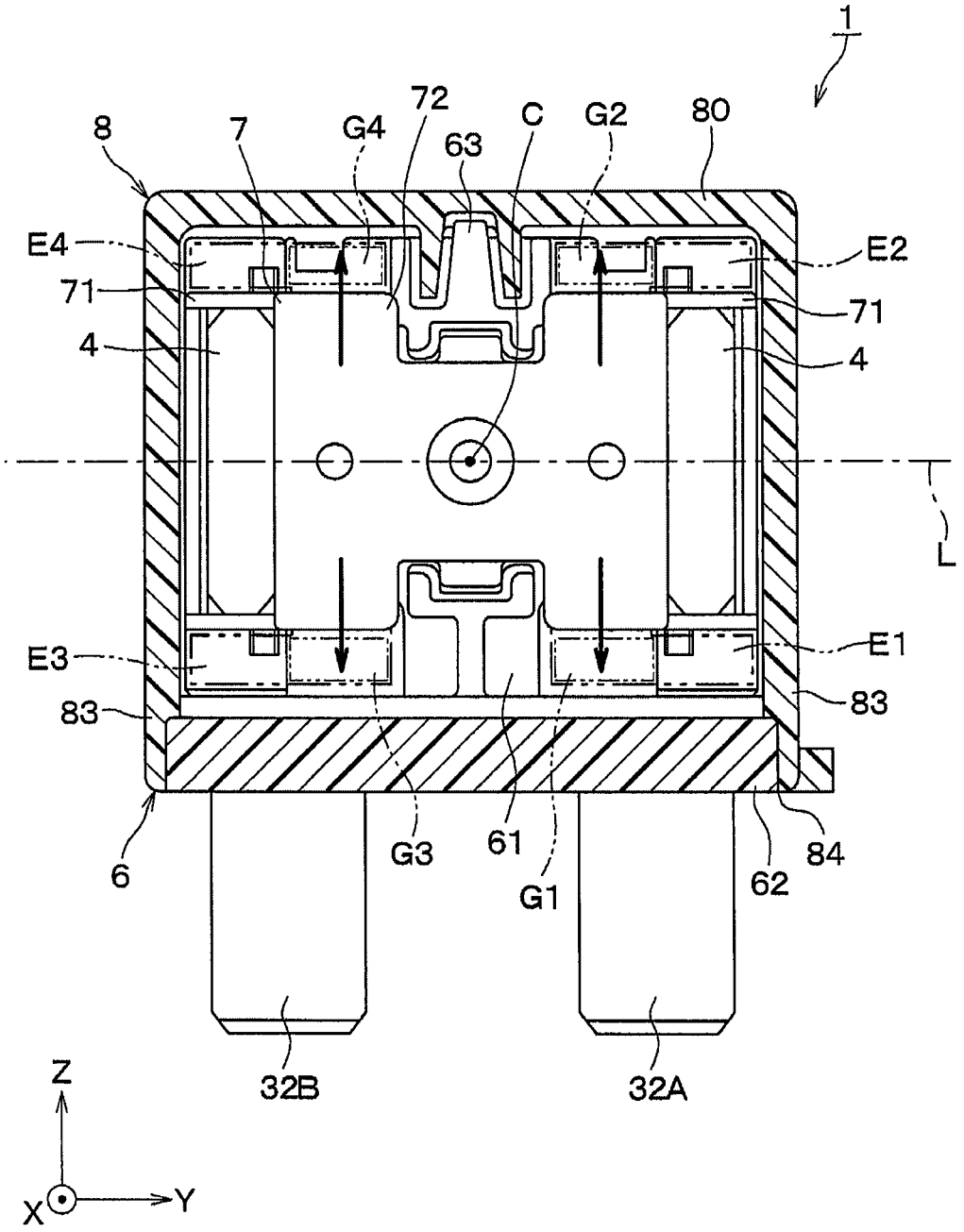
FIG. 4 is a sectional view taken along line IV-IV in FIG. 1.
Figure 5:
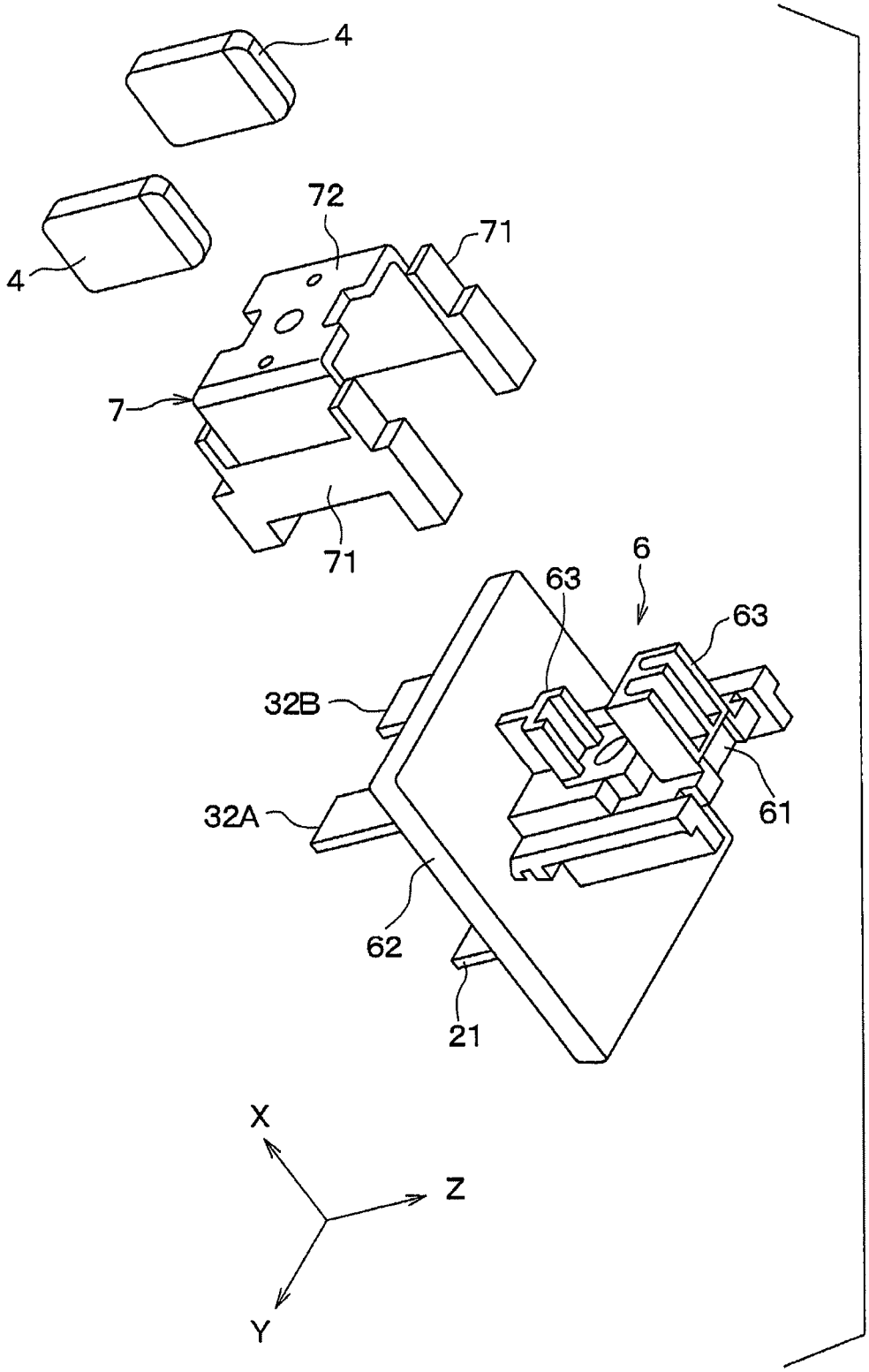
FIG. 5 is an exploded perspective view of permanent magnets, a base frame, and an intermediate cover illustrated in FIG. 1.

The first fixed element 31A includes the first fixed contact 33A. The first fixed contact 33A is an electrical contact member made from metal and having a substantially cylindrical shape with an axial center thereof parallel to the central axis line C. The first fixed contact 33A is secured to the first fixed element 31A by crimping or the like. The first fixed element 31A includes one first fixed contact 33A in the present embodiment. The first fixed contact 33A is placed such that the axial center thereof passes through a middle line L (see FIG. 3). The middle line L is a straight line orthogonal to the central axis line C and parallel to the width direction. As illustrated in FIG. 3, when viewed along the central axis line direction, the middle line L passes through the central axis line C, which looks like a dot in the view set forth.

The second fixed element 31B includes the second fixed contact 33B. The second fixed contact 33B is an electrical contact member made from metal and having a substantially cylindrical shape with an axial center thereof parallel to the central axis line C. The second fixed contact 33B is secured to the second fixed element 31B by crimping or the like. The first fixed contact 33A and the second fixed contact 33B are disposed on the different sides of the central axis line C in the width direction.

The second fixed element 31B includes two second fixed contacts 33B that are substantially symmetrically placed with respect to the middle line L in the present embodiment. The second fixed contacts 33B are placed such that a midpoint of a line segment connecting the two second fixed contacts 33B and the axial center of the first fixed contact 33A are substantially symmetrically placed with respect to the middle line L.

The movable element 34 is placed toward the return direction with respect to the first fixed element 31A and the second fixed element 31B so as to reciprocate in the central axis line direction in accordance with the energization state of the coil 2. Specifically, the movable element 34 is a metal plate member having a longitudinal direction thereof in the width direction and a plate thickness direction thereof in the central axis line direction. The movable element 34 is placed to face the first fixed element 31A and the second fixed element 31B in the central axis line direction.

The movable element 34 includes the first movable contact 35A on one end of the movable element 34 in the longitudinal direction. The movable element 34 includes the second movable contact 35B on the other end thereof in the longitudinal direction. That is, the first movable contact 35A and the second movable contact 35B are disposed on the different sides of the central axis line C in the width direction.

The first movable contact 35A is an electrical contact member made from metal and having a substantially cylindrical shape with an axial center thereof parallel to the central axis line C. The first movable contact 35A is secured to the movable element 34 by crimping or the like. The first movable contact 35A is placed to face the first fixed contact 33A in the central axis line direction. That is, the movable element 34 includes one first movable contact 35A in the present embodiment. When viewed along the central axis line direction, the first movable contact 35A coincides with the first fixed contact 33A.

The second movable contact 35B is an electrical contact member made from metal and having a substantially cylindrical shape with an axial center thereof parallel to the central axis line C. The second movable contact 35B is secured to the movable element 34 by crimping or the like. Second movable contacts 35B are placed to face the second fixed contacts 33B in the central axis line direction. That is, the movable element 34 includes two second movable contacts 35B in the present embodiment. When viewed along the central axis line direction, the second movable contacts 35B coincide with the second fixed contacts 33B.

The fixed yoke 36 is made from a ferromagnetic material (for example, magnetic metal) and supported firmly to the base frame 6 in a location near the first fixed element 31A and the second fixed element 31B. Specifically, the fixed yoke 36 is embedded in the base frame 6 by insert-molding or the like in a location that is closer to the central axis line C than the first fixed element 31A and the second fixed element 31B.

The movable yoke 37 is made from a ferromagnetic material (for example, magnetic metal) and coupled to the movable element 34. The movable yoke 37 is placed to face the fixed yoke 36 in the central axis line direction. The fixed yoke 36 and the movable yoke 37 are provided so as to generate a yoke attraction force therebetween in the energization state. In the energization state, the first fixed contact 33A is in contact with the first movable contact 35A, and the second fixed contacts 33B is in contact with the second movable contacts 35B, thereby causing the powering current or the regenerative current to flow through the movable element 34.

The contact pressure spring 38 is placed between the intermediate cover 7 and the coupled body of the movable element 34 and the movable yoke 37. The contact pressure spring 38 is a coil spring that urges the movable element 34 toward the attraction direction toward the first fixed element 31A and the second fixed element 31B.

The permanent magnet 4 is placed in proximity, in the width direction, to a location where the first fixed element 31A or the second fixed element 31B faces the movable element 34. Specifically, the permanent magnet 4 is attached to the intermediate cover 7, facing the said location across the intermediate cover 7 in the width direction. The phrase "placed in the proximity to" means that the permanent magnet 4 is placed in the proximity to the said location to the extent that the Lorentz force generated along the extending direction due to the magnetic flux of the permanent magnet 4 causes an arc that occurs between the first fixed element 31A or the second fixed element 31B and the movable element 34 at the time of the current shutoff to be stretched and extinguished favorably. The permanent magnet 4 is supported firmly to the intermediate cover 7 on an outer surface of the intermediate cover 7. The permanent magnet 4 is placed such that a magnetic pole direction thereof is parallel to the width direction.

The electromagnetic relay 1 according to the present embodiment includes two permanent magnets 4. One of the two permanent magnets 4 is placed toward the Y-axis positive direction with respect to the central axis line C, facing the first fixed contact 33A and the first movable contact 35A in the width direction across the intermediate cover 7. The other one of the two permanent magnets 4 is placed toward the Y-axis negative direction with respect to the central axis line C, facing the second fixed contacts 33B and the second movable contacts 35B in the width direction across the intermediate cover 7. That is, the permanent magnets 4 are disposed on the different sides of the central axis line C in the width direction.

The two permanent magnets 4 are oriented such that the respective S-poles face the central axis line C in the present embodiment. The two permanent magnets 4 have the same shape and are placed in the same position in the central-axis line direction and in the extending direction, coinciding with each other when viewed along the width direction.

The drive unit 5 is configured to cause the movable element 34 to reciprocate in the central axis line direction in accordance with the energization state of the coil 2. Specifically, the drive unit 5 includes a fixed core 51, a shaft 52, a movable core 53, a return spring 54, and a movable insulator 55.

The fixed core 51 is a substantially cylindrical member formed integrally and seamlessly from a ferromagnetic material (for example, a ferromagnetic metal material) and is accommodated in the coil 2. The shaft 52 is a cylindrical rod-like member made from metal and is placed such that a longitudinal direction thereof is parallel to the central-axis line direction. The shaft 52 is accommodated in a through hole formed in the fixed core 51 along an axial center of the fixed core 51 and can reciprocate along the central-axis line direction.

The movable core 53 is a substantially disk-like member made from a ferromagnetic material (for example, a ferromagnetic metal material) and is fixed to the shaft 52 in an intermediate position of the shaft 52 in the longitudinal direction of the shaft 52. The movable core 53 faces the fixed core 51 in the central axis line direction. The movable core 53 is thus attracted to the fixed core 51 when the coil 2 is energized. The attraction direction is a direction in which the movable core 53 is attracted to the fixed core 51 when the coil 2 is energized.

The return spring 54 is a coil spring placed around the fixed core 51 and the shaft 52 and urges the movable core 53 toward the return direction. The movable insulator 55 is made from an insulating material (for example, synthetic resin). The movable insulator 55 is secured to an end of the shaft 52 located toward the return direction, covering the end. When energization to the coil 2 is shut off and the movable core 53 moves toward the return direction, urged by the return spring 54, the movable insulator 55 comes in contact with the movable element 34, moving the movable element 34 toward the return direction.

The base frame 6 firmly supports the coil 2, the contact mechanism unit 3, the drive unit 5, and the intermediate cover 7. The base frame 6 is formed integrally and seamlessly from an insulating material (for example, synthetic resin). The base frame 6 includes a main body 61, a bottom plate 62, and a guide 63.

The main body 61 protrudes from the bottom plate 62 in the extending direction (i.e., toward the Z-axis positive direction). The main body 61 supports the fixed yoke 36 internally. The first fixed element 31A and the second fixed element 31B are supported firmly on a surface of the main body 61 that faces the movable element 34 in the central-axis line direction. The main body 61 has a through hole, through which the movable insulator 55 can pass, in a location corresponding to the central axis line C.

The bottom plate 62 is a plate portion having a plate thickness direction thereof in the extending direction and supports the main body 61 firmly. The main body 61 extends from the bottom plate 62 in the extending direction in a cantilever fashion. The bottom plate 62 has a rectangular shape when viewed along the extending direction.

The guide 63 extends from the main body 61 in the return direction. The guide 63 is formed to guide the reciprocating movement of the movable element 34 along the central-axis line direction.

Figure 2:
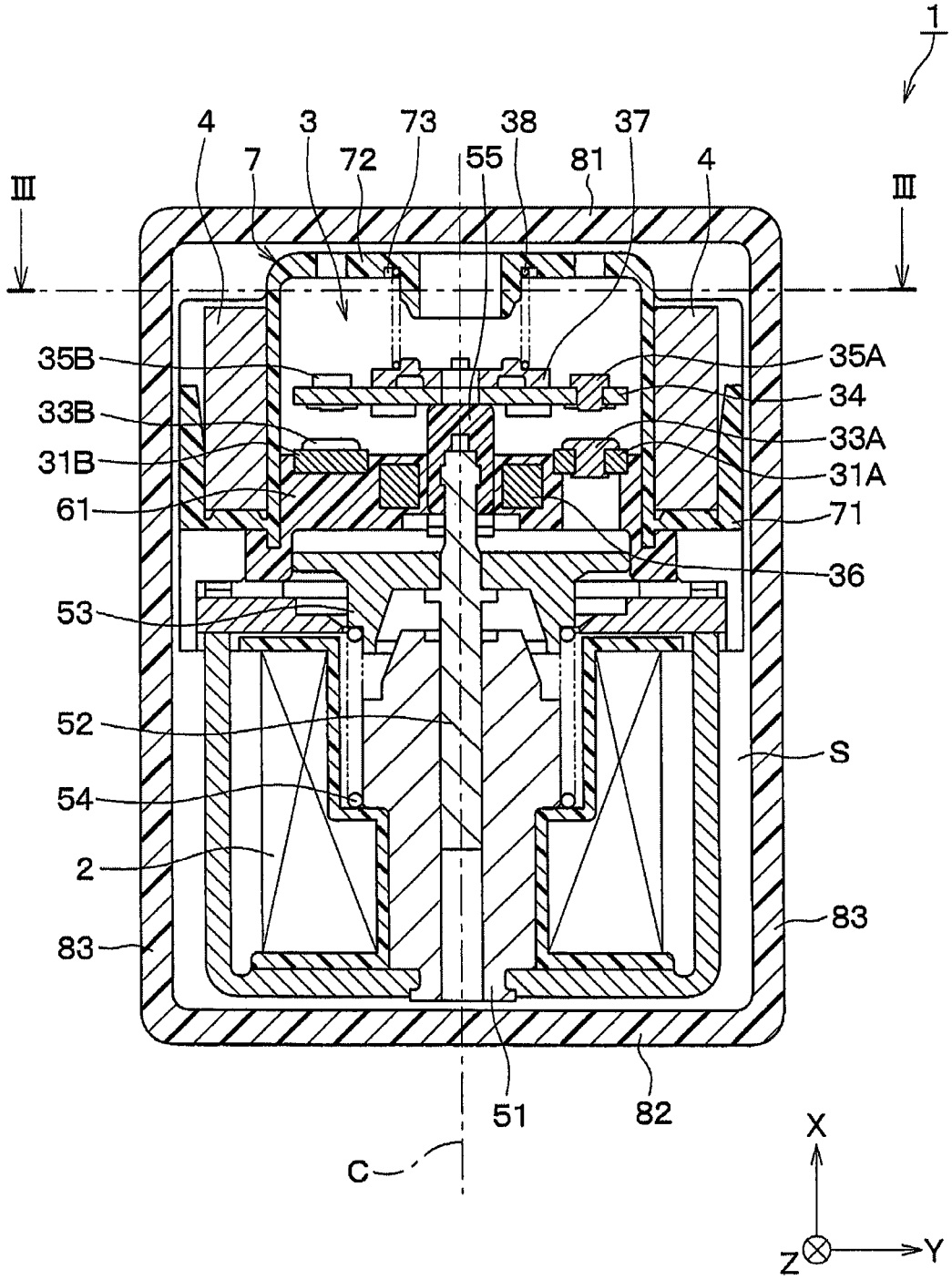
FIG. 2 is a sectional view taken along line II-II in FIG. 1.

The intermediate cover 7 is supported firmly to the main body 61 of the base frame 6 and covers the contact mechanism unit 3 from an upper side in the FIGS. 1 and 2. The intermediate cover 7 includes a pair of magnet retainers 71 facing each other in the width direction, and a covering plate 72 placed between the magnet retainers 71. The intermediate cover 7 is formed integrally and seamlessly from an insulating material (for example, synthetic resin).

The magnet retainer 71 has a recess having an opening in the return direction in one specific example illustrated in FIGS. 1 to 5 (note that the direction of the opening of the recess is presented as a mere example and that the recess can have an opening in another direction). The recess is formed so as to be able to retain the permanent magnet 4 internally. The magnet retainer 71 has a thin-plate wall facing the contact mechanism unit 3. The wall has an end located toward the return direction that is connected to the covering plate 72. That is, the permanent magnet 4 is in contact with an outer surface of the thin-plate wall described above.

The covering plate 72 is a plate portion having a rectangular shape with a plate thickness direction thereof in the central-axis line direction. The covering plate 72 extends in the width direction from the ends of the magnet retainers 71 located toward the return direction. The covering plate 72 thus faces the contact mechanism unit 3. The intermediate cover 7 is thus substantially U-shaped when viewed along the extending direction, with the magnet retainers 71 connected to the both ends of the covering plate 72 in the width direction. The intermediate cover 7 has a shape substantially symmetrical with respect to a plane passing through the central axis line C, the normal line of the plane being the middle line L.

A spring locking groove 73 is provided in an inner surface of the covering plate 72 that faces the contact mechanism unit 3. The spring locking groove 73 has a substantially ring-like shape and locks an end of the contact pressure spring 38 located toward the return direction.

The outer cover 8 has a bathtub shape having an opening in one face of the cuboid shape and is formed from an insulating material (for example, synthetic resin) integrally and seamlessly. Specifically, the outer cover 8 includes a top plate 80, a first side plate 81, a second side plate 82, and a pair of third side plates 83.

The top plate 80 is a flat-plate portion having a rectangular shape with a plate thickness direction thereof in the extending direction. The top plate 80 extends in the central-axis line direction and in the width direction. The top plate 80 is disposed to face the bottom plate 62 of the base frame 6 across the contact mechanism unit 3.

The first side plate 81 is a flat-plate portion having a rectangular shape with a plate thickness direction thereof in the central-axis line direction. The first side plate 81 is placed near the covering plate 72, facing the covering plate 72. That is, the first side plate 81 extends from an end of the top plate 80 that is located toward the return direction, facing the covering plate 72. The first side plate 81 extends in a direction parallel to the extending direction (i.e., toward the Z-axis negative direction).

The second side plate 82 is a flat-plate portion having a rectangular shape with a plate thickness direction thereof in the central-axis line direction. The second side plate 82 is disposed to face the first side plate 81 across the coil 2 and the contact mechanism unit 3. That is, the second side plate 82 extends from an end of the top plate 80 that is located toward the attraction direction. The second side plate 82 extends in a direction parallel to the extending direction (i.e., toward the Z-axis negative direction).

Each of the third side plates 83 is a flat-plate portion having a rectangular shape and has a plate thickness direction thereof in the width direction. One of the third side plates 83 is connected to one end of the top plate 80 located in the width direction, one end of the first side plate 81 located in the width direction, and one end of the second side plate 82 located in the width direction. The other one of the third side plates 83 is connected to the other end of the top plate 80 located in the width direction, the other end of the first side plate 81 located in the width direction, and the other end of the second side plate 82 located in the width direction.

The aforementioned bathtub shape, which is formed by the top plate 80, the first side plate 81, the second side plate 82, and the third side plates 83, has an opening 84 that opens along the extending direction (i.e., toward the Z-axis negative direction). The outer cover 8 and the bottom plate 62 of the base frame 6 cover the coil 2, the contact mechanism unit 3, the permanent magnets 4, the drive unit 5, and the intermediate cover 7 with the bottom plate 62 attached to the opening 84.

The outer cover 8 and/or the bottom plate 62 of the base frame 6 have/has a vent hole (not shown) through which the accommodation space S communicates with the outside air. The electromagnetic relay 1 according to the present embodiment thus has what one calls an "open-type" configuration, which allows the accommodation space S to communicate with the outside air.

A first gap G1 is formed between the covering plate 72 and the bottom plate 62 in the extending direction. A second gap G2 is formed between the covering plate 72 and the top plate 80 in the extending direction. The first gap G1 and the second gap G2 are spaces constituting portions of the accommodation space S and occupied by gas present in the accommodation space S (i.e., air). The first gap G1 and the second gap G2 are positioned toward the Y-axis positive direction with respect to the central axis line C (i.e., on the side of the central axis line C where the first fixed contact 33A and the first movable contact 35A are located). The first gap G1 and the second gap G2 are arranged in the extending direction substantially symmetrically with respect to the covering plate 72. The first gap G1 and the second gap G2 face the first side plate 81.

A third gap G3 is formed between the covering plate 72 and the bottom plate 62 in the extending direction. A fourth gap G4 is formed between the covering plate 72 and the top plate 80 in the extending direction. The third gap G3 and the fourth gap G4 are spaces constituting portions of the accommodation space S. The third gap G3 and the fourth gap G4 are positioned toward the Y-axis negative direction with respect to the central axis line C (i.e., on the side of the central axis line C where the second fixed contacts 33B and the second movable contacts 35B are located). The third gap G3 and the fourth gap G4 are arranged in the extending direction substantially symmetrically with respect to the covering plate 72. The third gap G3 and the fourth gap G4 face the first side plate 81.

A first extinguishing space E1, a second extinguishing space E2, a third extinguishing space E3, and a fourth extinguishing space E4 are also provided in the accommodation space S. The first extinguishing space E1 and the second extinguishing space E2 are spaces constituting portions of the accommodation space S. The first extinguishing space E1 and the second extinguishing space E2 are positioned toward the Y-axis positive direction with respect to the central axis line C (i.e., on the side of the central axis line C where the first fixed contact 33A and the first movable contact 35A are located). The third extinguishing space E3 and the fourth extinguishing space E4 are spaces constituting portions of the accommodation space S. The third extinguishing space E3 and the fourth extinguishing space E4 are positioned toward the Y-axis negative direction with respect to the central axis line C (i.e., on the side of the central axis line C where the second fixed contacts 33B and the second movable contacts 35B are located).

The first extinguishing space E1 is positioned toward the bottom plate 62 with respect to the middle line L (i.e., toward the Z-axis negative direction) for use as an extinguishing space when the regenerative current is shut off. The regenerative current flows from the second input/output terminal 32B through the second fixed element 31B, the second fixed contacts 33B, the second movable contacts 35B, the movable element 34, and the first movable contact 35A, the first fixed contact 33A, the first fixed element 31A, to the first input/output terminal 32A. The first extinguishing space E1 includes a space between the contact mechanism unit 3 and the bottom plate 62, the first gap G1, and a space between one of the magnet retainers 71 and the bottom plate 62.

The second extinguishing space E2 is positioned toward the top plate 80 with respect to the middle line L (i.e., toward the Z-axis positive direction) for use as an extinguishing space when the powering current is shut off. The powering current flows from the first input/output terminal 32A through the first fixed element 31A, the first fixed contact 33A, the first movable contact 35A, the movable element 34, the second movable contacts 35B, the second fixed contacts 33B, and the second fixed element 31B, to the second input/output terminal 32B. The second extinguishing space E2 includes a space between the contact mechanism unit 3 and the top plate 80, the second gap G2, and a space between the one of the magnet retainers 71 and the top plate 80.

The first extinguishing space E1 and the second extinguishing space E2 are arranged in the extending direction substantially symmetrically with respect to the covering plate 72 (i.e., substantially symmetrically with respect to the middle line L). The first extinguishing space E1 and the second extinguishing space E2 thus have substantially the same volume.

The first gap G1 and the second gap G2 are thus substantially symmetrical with respect to an imaginary plane including the middle line L and the central axis line C. The space between the contact mechanism unit 3 and the bottom plate 62, which is included in the first extinguishing space E1, and the space between the contact mechanism unit 3 and the top plate 80, which is included in the second extinguishing space E2, are also substantially symmetrical with respect to the aforementioned imaginary plane. The space between the one of the magnet retainers 71 and the bottom plate 62, which is included in the first extinguishing space E1, and the space between the one of the magnet retainers 71 and the top plate 80, which is included in the second extinguishing space E2, are also substantially symmetrical with respect to the aforementioned imaginary plane.

The third extinguishing space E3 is positioned toward the bottom plate 62 with respect to the middle line L (i.e., toward the Z-axis negative direction) for use as an extinguishing space when the regenerative current is shut off. The third extinguishing space E3 includes a space between the contact mechanism unit 3 and the bottom plate 62, the third gap G3, and a space between the other one of the magnet retainers 71 and the bottom plate 62.

The fourth extinguishing space E4 is positioned toward the top plate 80 with respect to the middle line L (i.e., toward the Z-axis positive direction) for use as an extinguishing space when the powering current is shut off. The fourth extinguishing space E4 includes a space between the contact mechanism unit 3 and the top plate 80, the fourth gap G4, and a space between the other one of the magnet retainers 71 and the top plate 80.

The third extinguishing space E3 and the fourth extinguishing space E4 are arranged in the extending direction substantially symmetrically with respect to the covering plate 72 (i.e., substantially symmetrically with respect to the middle line L). The third extinguishing space E3 and the fourth extinguishing space E4 thus have substantially the same volume.

As described above, the first extinguishing space E1 and the third extinguishing space E3 are disposed on the different sides of the central axis line C in the width direction in the electromagnetic relay 1 according to the present embodiment. The second extinguishing space E2 and the fourth extinguishing space E4 are also disposed on the different sides of the central axis line C in the width direction.

The electromagnetic relay 1 according to the present embodiment is configured to allow air to flow from the first gap G1 to the second gap G2 via the first extinguishing space E1, a space in the intermediate cover 7, and the second extinguishing space E2. The electromagnetic relay 1 according to the present embodiment is configured to allow air to similarly flow from the third gap G3 to the fourth gap G4 via the third extinguishing space E3, a space in the intermediate cover 7, and the fourth extinguishing space E4.

(Effects)

When the regenerative current is shut off, the direction of current flow of an arc occurring between the first fixed contact 33A and the first movable contact 35A is from the first movable contact 35A toward the first fixed contact 33A. The arc is thus subjected to the Lorentz force extending toward the Z-axis negative direction in the first extinguishing space E1.

When the powering current is shut off, the direction of current flow of an arc occurring between the first fixed contact 33A and the first movable contact 35A is from the first fixed contact 33A toward the first movable contact 35A. The arc is thus subjected to the Lorentz force extending toward the Z-axis positive direction in the second extinguishing space E2.

When the regenerative current is shut off, the direction of current flow of an arc occurring between the second fixed contacts 33B and the second movable contacts 35B is from the second fixed contacts 33B to the second movable contacts 35B. The arc is thus subjected to the Lorentz force extending toward the Z-axis negative direction in the third extinguishing space E3.

When the powering current is shut off, the direction of current flow of an arc occurring between the second fixed contacts 33B and the second movable contacts 35B is from the second movable contacts 35B toward the second fixed contacts 33B. The arc is thus subjected to the Lorentz force extending toward the Z-axis positive direction in the fourth extinguishing space E4.

The first extinguishing space E1 in the present embodiment includes a space adjacent to the contact mechanism unit 3 (i.e., where the first fixed contact 33A faces the first movable contact 35A) in the extending direction as well as the first gap G1, which is adjacent to the said space in the central-axis line direction. That is, the first extinguishing space E1 according to the present embodiment is a space enlarged in the central-axis line direction, extending from the space adjacent to the contact mechanism unit 3 in the extending direction to a location facing the first side plate 81. The same applies to the third extinguishing space E3. The configuration thus enables favorable extinction of an arc in the first extinguishing space E1 and the third extinguishing space E3. Favorable shutoff performance can thus be ensured for shutting off the regenerative current.

The second extinguishing space E2 in the present embodiment includes a space adjacent to the contact mechanism unit 3 in the extending direction as well as the second gap G2, which is adjacent to the said space in the central-axis line direction. That is, the second extinguishing space E2 according to the present embodiment is a space enlarged in the central-axis line direction, extending from the space adjacent to the contact mechanism unit 3 in the extending direction to a location facing the first side plate 81. The same applies to the fourth extinguishing space E4. The configuration thus enables favorable extinction of an arc in the second extinguishing space E2 and the fourth extinguishing space E4. Favorable shutoff performance can thus be ensured for shutting off the powering current.

The electromagnetic relay 1 according to the present embodiment has what one calls an "open-type" configuration, which allows the accommodation space S to communicate with the outside air as described above. That is, the accommodation space S of the electromagnetic relay 1 according to the present embodiment is not filled with an arc-extinguishing gas for facilitating extinction of an arc. The electromagnetic relay 1 according to the present embodiment, however, includes the first extinguishing space E1 to the fourth extinguishing space E4, which are extinguishing spaces that enable favorable current shutoff, as described above. The configuration can thus provide favorable current shutoff properties without employing a sealed structure filled with an arc-extinguishing gas.

Additionally, the first extinguishing space E1 for shutting off the regenerative current and the second extinguishing space E2 for shutting off the powering current are arranged in the extending direction substantially symmetrically with respect to the covering plate 72 and have substantially the same volume in the present embodiment. The third extinguishing space E3 for shutting off the regenerative current and the fourth extinguishing space E4 for shutting off the powering current are similarly arranged in the extending direction substantially symmetrically with respect to the covering plate 72 and have substantially the same volume.

The configuration can thus curb to the extent possible a significant difference in shutoff performance between when the regenerative current is shut off and when the powering current is shut off. The configuration thus eliminates constraints of polarity in connection to the first input/output terminal 32A and the second input/output terminal 32B in the electromagnetic relay 1. Accordingly, a heightened degree of freedom in design and a wide applicable range can be provided.

Additionally, the first extinguishing space E1 according to the present embodiment includes the space between the contact mechanism unit 3 and the bottom plate 62 as well as the first gap G1 and the space between the one of the magnet retainers 71 and the bottom plate 62. The same applies to the second extinguishing space E2 to the fourth extinguishing space E4. Furthermore, the accommodation space S including the first extinguishing space E1 to the fourth extinguishing space E4 communicates with the outside air. The configuration can thus release heat produced in the contact mechanism unit 3 to the outside favorably.

Furthermore, the configuration according to the present embodiment allows air to flow favorably from the first gap G1 to the second gap G2 via the first extinguishing space E1, the space in the intermediate cover 7, and the second extinguishing space E2. The configuration according to the present embodiment similarly allows air to favorably flow from the third gap G3 to the fourth gap G4 via the third extinguishing space E3, the space in the intermediate cover 7, and the fourth extinguishing space E4.

The configuration can thus release heat produced in the contact mechanism unit 3 to the outside favorably. When a high-speed compressed air flow is injected from a second extinguishing space E2 side toward the Z-axis negative direction for removal of dust and the like during the manufacturing process of the electromagnetic relay 1, the air flow favorably passes through the first gap G1 toward the X-axis positive direction. When a high-speed compressed air flow is similarly injected from a fourth extinguishing space E4 side toward the Z-axis negative direction, the air flow favorably passes through the third gap G3 toward the X-axis positive direction. Even when the direction of the compressed air flow is opposite to those in the examples described above, the result is similar.

(Modification)

The present disclosure is not limited to the specific examples described in the foregoing embodiment. The embodiment described above can be modified as appropriate. Some representative modifications are described below. Difference from the embodiment described above only is explained in the description of modifications presented below. Constituent elements of the modifications identical with or equivalent to those in the embodiment described above are designated with the identical symbols. For constituent elements of the modifications described below that are designated with symbols identical with those in the embodiment described above, the description provided in the foregoing embodiment can be referenced as appropriate as long as there is no technical contradiction or no specific additional explanation is provided.

The present disclosure is not limited to the specific configuration described in the foregoing embodiment. For example, the use of the electromagnetic relay 1 is not limited to a drive power supply system installed in an electrically driven vehicle. That is, the current that flows through the electromagnetic relay 1 is not limited to the powering current and the regenerative current.

The electromagnetic relay 1 may have a sealed structure in which an accommodation space S is a sealed space. In such cases, the accommodation space S may be filled with an arc-extinguishing gas.

Two first fixed contacts 33A may be placed symmetrically with respect to the middle line L, similarly to the second fixed contacts 33B. Alternatively, one second fixed contact 33B may be placed on the middle line L, similarly to the first fixed contact 33A.

Other arbitrary modifications can be also made to the contact mechanism unit 3.

The orientations of the magnetic poles of the permanent magnets 4 can be changed as appropriate. For example, the two permanent magnets 4 may be oriented such that the respective N-poles face the central axis line C. Alternatively, the two permanent magnets 4 may be oriented such that the respective N-poles face the Y-axis positive direction. That is, the two permanent magnets 4 may be oriented such that the respective like-poles face each other. The configuration of the drive unit 5 is not limited to the specific example in the embodiment described above.

As described above, each of the magnet retainers 71 has a recess that can retain the permanent magnet 4 internally, the recess having an opening in the return direction. The direction of the opening is not limited to the return direction and may be, for example, in the attraction direction or the extending direction.

While the first gap G1 and the second gap G2 are placed substantially symmetrically with respect to the covering plate 72 or the middle line L, the first gap G1 and the second gap G2 are not required to be perfectly symmetrical. That is, the first gap G1 and the second gap G2 only have to have symmetry in position and shape to the extent that can be substantially described as symmetry; thus, a slight loss of symmetry, a minute difference in volume, and a minute difference in dimension between the first gap G1 and the second gap G2 are permissible. The same applies to the symmetries between the first extinguishing space E1 and the second extinguishing space E2, between the third gap G3 and the fourth gap G4, and between the third extinguishing space E3 and the fourth extinguishing space E4.

Any of the constituent elements formed seamlessly and integrally in the foregoing description may be formed integrally with a seam using methods such as bonding multiple constituent elements. For example, the main body 61 of the base frame 6 may be bonded to the bottom plate 62. Similarly, any of the constituent elements joined together with a seam may be formed seamlessly and integrally.

The materials of the constituent elements are not particularly limited. For example, the movable insulator 55, the base frame 6, the intermediate cover 7, and the outer cover 8 are typically made from insulating synthetic resin as described above. The constituent elements that are conductive and the constituent elements that are ferromagnetic are typically made from metal. The present disclosure, however, is not limited to such materials.

Modifications are also not limited to the examples described above. Multiple modifications can be combined. Furthermore, all or part of the embodiment described above and all or part of the modifications can be combined.

While the present disclosure has been described with reference to embodiments thereof, it is to be understood that the disclosure is not limited to the embodiments and constructions. To the contrary, the present disclosure is intended to cover various modification and equivalent arrangements. In addition, while the various elements are shown in various combinations and configurations, which are exemplary, other combinations and configurations, including more, less or only a single element, are also within the spirit and scope of the present disclosure.

What is claimed is:

1. An electromagnetic relay comprising:

a contact mechanism unit including: a fixed element having a fixed contact; and a movable element having a movable contact facing the fixed contact in a central-axis line direction of a coil, the movable element reciprocating in the central-axis line direction in accordance with an energization state of the coil;

a base frame including: a main body that fixes and supports the fixed element; and a bottom plate that is a rectangular plate portion having a plate thickness direction in an extending direction that is orthogonal to the central-axis line direction, the bottom plate fixing and supporting the main body, the main body extending from the bottom plate in the extending direction, the base frame being formed integrally from an insulating material;

a permanent magnet having a magnetic pole direction parallel to a width direction that is orthogonal to the central-axis line direction and the extending direction, the permanent magnet being placed in proximity, in the width direction, to the fixed element and the movable element;

an intermediate cover including: a magnet retainer that retains the permanent magnet; and a covering plate that is a rectangular plate portion extending in the width direction from an end of the magnet retainer in the central-axis line direction, the covering plate facing the contact mechanism unit, the intermediate cover being formed integrally from an insulating material and supported and fixed by the base frame; and an outer cover including: a top plate extending in the central-axis line direction and the width direction and facing the bottom plate across the contact mechanism unit; a first side plate extending in a direction parallel to the extending direction from one end of the top plate in the central-axis line direction and facing the covering plate; a second side plate extending in a direction parallel to the extending direction from another end of the top plate in the central-axis line direction and facing the first side plate across the contact mechanism unit and the coil; and a pair of third side plates connected to the top plate, the first side plate and the second side plate, the outer cover being formed integrally from an insulating material, the outer cover having an opening of a bathtub shape formed by the top plate, the first side plate, the second side plate and the pair of third side plates, the bottom plate being attached to the opening, the outer cover covering the contact mechanism unit and the intermediate cover, wherein a first gap formed between the covering plate and the bottom plate in the extending direction and a second gap formed between the covering plate and the top plate in the extending direction are arranged to be substantially symmetric across the covering plate in the extending direction, the first gap and the second gap being provided on the first side plate.

2. The electromagnetic relay according to claim 1, wherein a first extinguishing space and a second extinguishing space are arranged to be substantially symmetric across the covering plate in the extending direction, the first extinguishing space being formed of the first gap and a space between the contact mechanism unit and the bottom plate, the second extinguishing space being formed of the second gap and a space between the contact mechanism unit and the top plate.

3. The electromagnetic relay according to claim 2, wherein the fixed contact is one of two fixed contacts disposed on different sides of a central axis line of the coil in the width direction, the movable contact is one of two movable contacts disposed on the different sides of the central axis line in the width direction, the permanent magnet is one of two permanent magnets disposed on the different sides of the central axis line in the width direction, the intermediate cover is substantially U-shaped, the magnet retainer being one of two magnet retainers connected to different ends of the covering plate in the width direction, the first extinguishing space is one of two first extinguishing spaces disposed on the different sides of the central axis line in the width direction, and the second extinguishing space is one of two second extinguishing spaces disposed on the different sides of the central axis line in the width direction.

4. The electromagnetic relay according to claim 1, wherein the electromagnetic relay is configured to allow air to flow from the first gap to the second gap through a space inside the intermediate cover.

5. The electromagnetic relay according to claim 1, wherein an accommodation space surrounded by the outer cover and the base frame communicates with outside air.

6. An electromagnetic relay comprising:

a contact mechanism unit including a fixed contact and a movable contact facing each other in a central-axis line direction of a coil;

a base frame made of an insulating material, and including a main body that fixes and supports the fixed contact, and a bottom plate from which the main body extends in an extending direction that is orthogonal to the central-axis line direction;

a pair of permanent magnets facing each other across the contact mechanism unit in a width direction that is orthogonal to the central-axis line direction and the extending direction;

a magnet retainer made of an insulating material and fixed to the base frame, the magnet retainer retaining the pair of permanent magnets and including a covering plate that extends in the width direction and faces the base frame in the central-axis line direction across the contact mechanism unit; and an outer cover attached to the bottom plate of the base frame and housing the main body of the base frame, the contact mechanism unit, the pair of permanent magnets and the magnet retainer, the outer cover including: a top plate extending in the central-axis line direction and the width direction and facing the bottom plate across the contact mechanism unit in the extending direction; and a first side plate extending in a direction parallel to the extending direction from an end of the top plate and facing the base frame in the central-axis line direction across the covering plate and the contact mechanism unit, wherein a first gap between the covering plate and the bottom plate in the extending direction and a second gap between the covering plate and the top plate in the extending direction are symmetric across the covering plate in the extending direction.

* * * * *